US005693906A

United States Patent [19]

Van Sloun

[11] Patent Number: 5,693,906

[45] Date of Patent: Dec. 2, 1997

[54] ELECTRO-MECHANICAL SAFETY AND ARMING DEVICE

[75] Inventor: Peter H. Van Sloun, Hopkins, Minn.

[73] Assignee: Alliant Techsystems Inc., Hopkins, Minn.

[21] Appl. No.: 535,744

[22] Filed: Sep. 28, 1995

[51] Int. Cl.[6] ..... F42C 15/24

[52] U.S. Cl. ..... 102/251; 102/228; 102/229; 102/248; 102/249; 102/254

[58] Field of Search ..... 102/223, 228, 102/229, 231, 232, 233, 235, 247, 248, 249, 251, 254, 255

[56] References Cited

U.S. PATENT DOCUMENTS

| | | | |
|---|---|---|---|
| 2,969,737 | 1/1961 | Bild . | |
| 3,181,467 | 5/1965 | Jacob et al. . | |
| 3,823,669 | 7/1974 | Zacharin . | |
| 4,128,061 | 12/1978 | Kaiser . | |
| 4,440,086 | 4/1984 | Brotherton et al. . | |
| 4,449,457 | 5/1984 | Halssig . | |
| 4,464,991 | 8/1984 | Kaiser . | |
| 4,573,411 | 3/1986 | Liebhardt et al. . | |
| 4,691,634 | 9/1987 | Titus et al. . | |
| 4,770,096 | 9/1988 | Maruska et al. . | |
| 4,796,532 | 1/1989 | Webb . | |
| 4,854,239 | 8/1989 | Van Sloun . | |
| 4,876,960 | 10/1989 | Schillinger et al. . | |
| 4,899,659 | 2/1990 | Hardt | 102/229 |
| 4,969,397 | 11/1990 | Gunther et al. . | |
| 4,995,317 | 2/1991 | Bankel et al. . | |
| 5,126,559 | 6/1992 | Reynolds . | |
| 5,131,328 | 7/1992 | Chan | 102/249 |
| 5,275,107 | 1/1994 | Weber et al. . | |

FOREIGN PATENT DOCUMENTS

| | | | |
|---|---|---|---|
| 667672 | 7/1939 | Germany | 102/233 |
| 25 33 644 | 5/1975 | Germany . | |
| 3321 191 A1 | 12/1984 | Germany . | |
| 186056 | 11/1963 | Sweden | 102/235 |
| 540289 | 10/1941 | United Kingdom | 102/247 |
| 2 183 798 | 12/1985 | United Kingdom . | |

*Primary Examiner*—Harold J. Tudor
*Attorney, Agent, or Firm*—Vidas, Arrett & Steinkraus, P.A.

[57] ABSTRACT

An apparatus and method for safing and arming a projectile is disclosed. The apparatus utilizes an out of line rotor configuration where the detonator is mounted in the rotor. In the safe position, the detonator is out of line with an explosive lead. The rotor is locked out of line with two independent locks. One lock is removed at gun launch setback and the second lock is removed at the time of arming, when a preselected environment is detected by electronics and safe separation is assured. The first lock includes a spring and a weight where the weight is biased in a position to prevent the rotor from moving to an in line position. At setback, the g-forces act on the weight to overcome the spring and the weight is removed from the path of the rotor. Once the selected environment is sensed and safe separation is established the electronic input to arming is permitted. A primer is ignited to remove the second lock shear tab and rotate the rotor to the armed position where the detonator is aligned with the explosive lead. A firing circuit can then be employed to ignite the detonator causing propagation of hot gases and particles to the explosive lead which ignites the warhead explosive/propellent of the projectile.

13 Claims, 5 Drawing Sheets

ELECTRO-MECHANICAL SAFETY AND ARMING DEVICE

FIELD OF THE INVENTION

This invention relates to safety and arming devices for use with fuzes and more particularly, to an electro-mechanical safety and arming apparatus for use with a bursting munition fuze, specifically for smaller rounds down to the 20 mm size.

BACKGROUND OF THE INVENTION

A safety and arming device is a required element of a munition to ensure that the munition is not armed and detonated until the desired time. The safety and arming device (S & A) is part of a munition's fuze and prevents arming of the fuze until certain conditions are met.

Many safety and arming devices require two environments or occurrences for operation and initiation of the fuze. The first environment utilized is usually setback. Setback acceleration of the munition is an easily sensed environment. The second environment can be based on a number of different parameters such as timing, barrel escape, turns counting, etc.

Examples of prior devices used to detect and integrate the setback acceleration environment include G-weight driven escapements, successive falling leaves, zig-zag G-weights and variations and combinations of these. Most of these examples suffer from several drawbacks including having a great number of parts, requiring close tolerances, and having limited accuracy and reliability. More specifically, in prior safety and arming devices, mechanical devices have been used where it is required that a second latch must move to catch the setback lock before rebounding. This creates a race condition where the second latch has to catch the lock before rebounding for the device to work. Also, other designs require a leaf spring or other element to move into a recess to latch. Often the time for the element to move into the recess and the time for the lock weight to rebound are incompatible. These designs are of lower reliability than desired and cause greater risk of malfunction. Further, prior devices, because of the great number of parts, require more space than is sometimes desired or available. Prior devices have not afforded the precision of the range at which all rounds can be armed. A "safe separation" distance is identified for a munition. This distance is the distance from the gun that must be reached before a round will arm. A plus tolerance is added to the distance to identify the "all arm" range. For example, small caliber mechanical fuzes using porous restrictors to achieve safe separation have an all arm at 1000% of safe separation and those using an unwinding ribbon have an all arm at 300%. These all arm ranges are unacceptable for some encounters or situations.

Further, prior devices are not easily modified to be utilized in rounds of various sizes, especially smaller rounds. It is desirable to design a safety and arming device which is able to be used in several different size rounds, particularly munitions equal to or less than 20 mm.

It has also been found desirable to combine the higher reliability and accuracy of electronics for timing and control functions for the safety afforded by mechanical obstruction of a firing train. By doing so, major improvements in performance, reliability, and producibility are provided.

Therefore, a need arises for an electro-mechanical safety and arming mechanism which addresses and solves the problems of prior devices. The present invention provides an S & A which can be utilized in rounds of various sizes, including rounds down to the 20 mm size. The all arm range is approximately 10% past the safe separation range. The invention also reduces the number of components used in prior devices. The invention utilizes setback latching based on the dynamics of the setback weight instead of additional components which avoids the race condition of prior devices. The invention uses an integral primer in a base/rotor configuration for final unlocking and arming to provide a more reliable device.

SUMMARY OF THE INVENTION

The present invention provides a reliable and simple safety and arming device which combines mechanics and electronics. The safety and arming device utilizes an out of line rotor configuration in which the detonator is mounted in the rotor. In the safe position the rotor is out of line with the explosive lead. The rotor is locked out of line with two independent locks. One lock is removed at gun launch setback, the first environment. The second lock is removed at the time of arming, when the second environment is detected. Electronics detects the second environment and assures a safe separation. Once safe separation is satisfied the electronic input to arming is permitted.

In a preferred embodiment constructed according to the principles of the invention, a safe and arming apparatus is provided. The apparatus includes a housing; a rotor connected to the housing and rotatable about an axis, the rotor movable between a safe position and an armed position; first lock means connected to the housing for preventing the rotor from moving from the safe position to the armed position, the first lock means including a mass and a biasing means, the biasing means operatively connected to the housing and the mass, for biasing the mass into a first position which prevents rotation of the rotor and for allowing the mass to move into a second position out of the path of the rotor upon a predetermined acceleration of the projectile; second lock means connected to the rotor for preventing the rotor from moving from the safe position to the armed position; a primer connected to the housing and proximate the second lock means; and primer ignition means connected to the primer for sensing a predetermined condition and igniting the primer when the predetermined condition of the projectile is sensed wherein when the primer ignites, the second lock is removed and the rotor is moved to the armed position; whereby when the predetermined acceleration has occurred, the first lock means is moved out of the path of the rotor and when the predetermined condition has been sensed the primer ignition means ignites the primer, removing the second lock means and the rotor is moved to the armed position.

The device is a simple solution to the sating and arming problem, especially in smaller rounds. The first lock acts under the setback acceleration forces and is removed without additional mechanisms or catches. The dynamics of the setback weight act to move the lock out of the path of the rotor. Additional elements or mechanisms are not required to contain or operate the lock as in prior systems.

Yet another advantage is the use of the integral primer. The primer allows tier a simple way to remove the second lock or shear tab of the device. The primer adds reliability to the final unlocking stage of the safe and arming device. The use of the primer simplifies the transfer from the safe to the armed position. The primer moves the rotor configuration to the armed position.

Still another advantage of the invention is the use of the electronics to sense the selected predetermined condition and establish the all arm range. The safe separation distance is established and the all arm range can be approximately 10% past the safe separation range.

These and other advantages and features which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a preferred embodiment to the invention.

BRIEF DESCRIPTION OF THE FIGURES

Referring to the Drawings, wherein like numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

The safe and arming device utilizes an out of line rotor configuration in which a detonator is mounted in a rotor. It is safe when the rotor is in the out of line position because the explosive lead is shielded from the detonator. When the rotor is in the in line position the detonator is proximate the explosive lead and propagation is assured. The rotor is locked out of line by two independent locks. The first lock requires gun launch setback g-forces to remove it and the second lock is a shear tab which is part of the rotor. It is sheared at the time of arming. Electronics detects a specific predetermined environment and assures safe separation between the user and target. Once safe separation is satisfied, the electronic input to arming is permitted. An anti-rebound spring acts as an anti-rebound stop for the rotor. Arming can be delayed until just before detonation, if desired. This provides safety for friendly troops located beyond the safe separation zone but before the target area.

Figure 1:
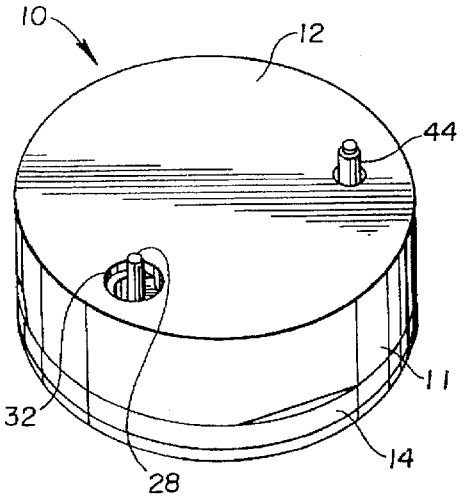
FIG. 1 is a perspective view of a safe and arming device of the invention as assembled.
Figure 13:
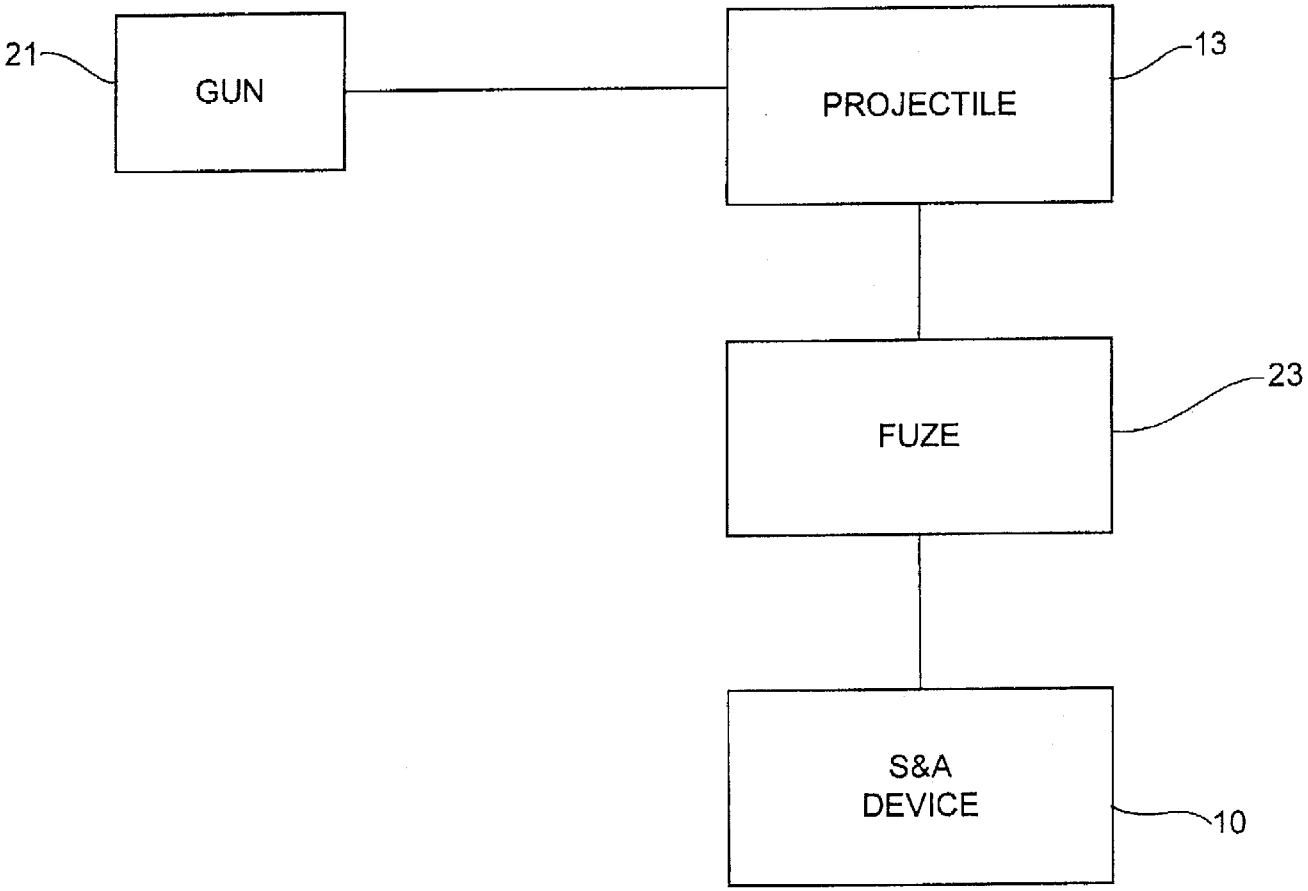
FIG. 13 is a high level block diagram illustrating the relationship of the gun, projectile, fuze and safe and arming device.

Referring now to FIG. 1, the safe and arming invention 10 is shown assembled within its housing 11, where the housing 11 includes cover 12 and base 14. As illustrated in FIG. 13, the device or apparatus 10 is placed within a projectile or munition 13 for use. The projectile or munition 13 is then fired from a gun 21. Any appropriate type of munition or projectile 13 and appropriate gun 21 may be used with the invention. Because of its versatile design, the preferred embodiment of the apparatus 10 may be of a size approximate to 0.50 inches in diameter and approximately 0.20 inches in length and therefore, is particularly suited for munitions down to the 20 mm size. More specifically, the safe and arming apparatus is designed for a projectile of the bursting munitions type such as an enhanced 20 mm round.

The device 10 is located within the projectile 13 and is part of the fuzing system 23 and operatively connected to that system. The device 10 is positioned within the projectile in an appropriate manner such that the device 10 may be armed and detonated at the desired time. Also, the device is oriented so the setback lock to be described below may operate in its intended manner at setback and utilize the g-forces to move the lock. In the preferred embodiment, the device is oriented so that the cover 12 is closer to the tip of the projectile 13 than the base 14 and the axis of the projectile and device 10 are generally parallel or may be axially aligned. The device i0 is powered by the battery of the fuze system 23. The cover 12 and base 14 are made of aluminum in the preferred embodiment and form a generally cylindrical device. Any other suitable materials may be utilized. The device 10 is also configured for various applications and may be of any appropriate shape and size.

Figure 2:
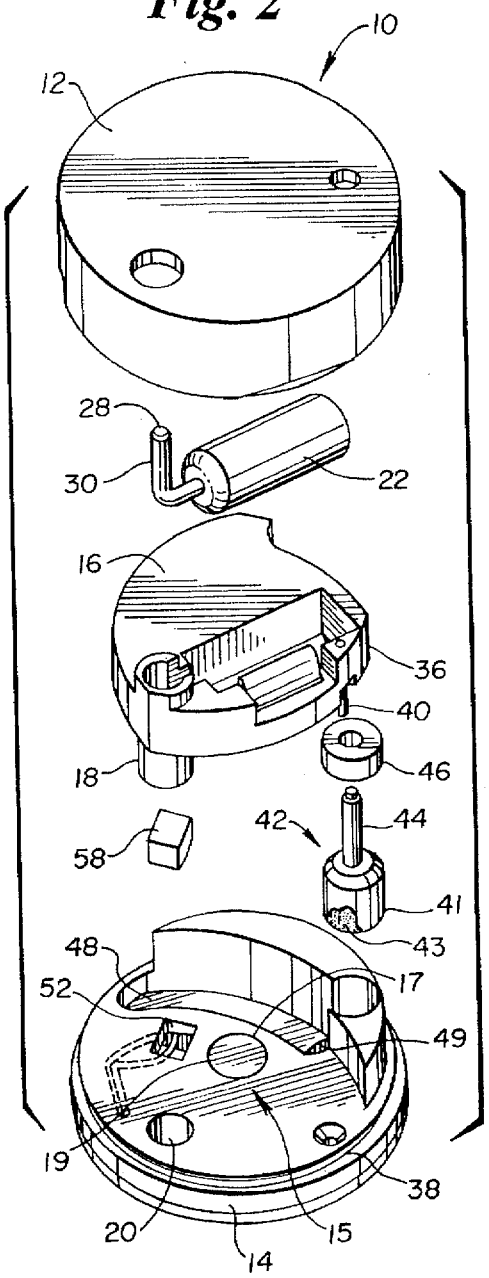
FIG. 2 is an exploded perspective view of a safe and arming device constructed according to the principles of the invention.
Figure 3:
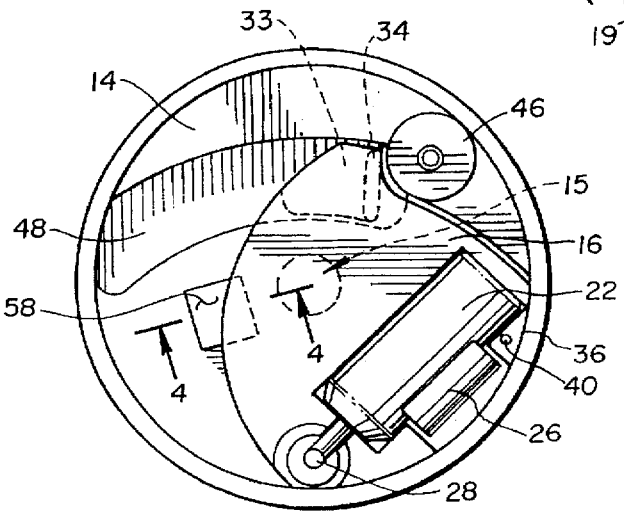
FIGS. 3 is a top plan view of the safe and arming device with the cover removed and in the unarmed position.

Reference is made to FIG. 2 which is an exploded perspective view of the apparatus 10. Referring also to FIG. 3, the rotor 16 is shown. The rotor 16 is made of aluminum in the preferred embodiment but those skilled in the art will understand that several materials may be utilized including steel. The rotor 16 is sized and configured to work within the parameters of the housing 11. The rotor 16 rotates about a pivot point or axis by means of a rotor pivot shaft or member 18. The member 18 is received by and pivots within an aperture 20 in the base 14.

The rotor 16 is configured to hold a detonator 22. In the preferred embodiment, the detonator 22 rests in a cut-out or recess 24 and is held in place by retainer 26. Any suitable means to secure the detonator 22 may be utilized. The detonator 22 includes a connecting wire or detonator lead 28. The connecting wire 28 is configured and located axially within the shaft 18 to permit rotation and is connected to the firing electronics to be described later. In the preferred embodiment, the wire 28 is surrounded by an insulator 30. The wire 28 protrudes through the cover 12 through aperture 32 for connection. The rotor pivot point, the wire 28, aperture 32, aperture 20 and shaft 18 are generally axially aligned.

The rotor 16 is shown in the "out of line" position in FIG. 3. The out of line position or safe position refers to the position of the rotor 16 where the detonator 22 is not aligned with or proximate to the explosive lead 15. There is no aligned firing train. The explosive lead 15 is of the type including a suitable explosive. The lead 15 is positioned in the base 14 in the preferred embodiment. The explosive lead 15 includes a cavity 17, explosive (not shown) and cover member 19 in the preferred embodiment. The base 14 is milled so that a cavity 17 is formed. The cavity 17 is filled with an explosive or energetic material known to those skilled in the art. In the preferred embodiment, the explosive used is PBXN5. The cover member 19 is a disk shaped piece of aluminum foil in the preferred embodiment. The foil 19 is adhesive backed so that it may adhere to the base 14 and cover the explosive and cavity 17. It should be understood that any other suitable configuration of the assembly 15 may be appropriate. One skilled in the art will understand that any type of suitable explosive may be used in cavity 17 and that the size and configuration of the cavity 17 and foil 19 may be of any suitable type. Any suitable means for attaching the foil 19 to the base 14 may also be used and are known to those skilled in the art. Also, it should be understood that an additional lead may be utilized for some applications. This second lead would be beneath the base so that the lead 15 would ignite and then ignite the second lead. The second lead may be a lead pellet of a known type.

Figure 10:
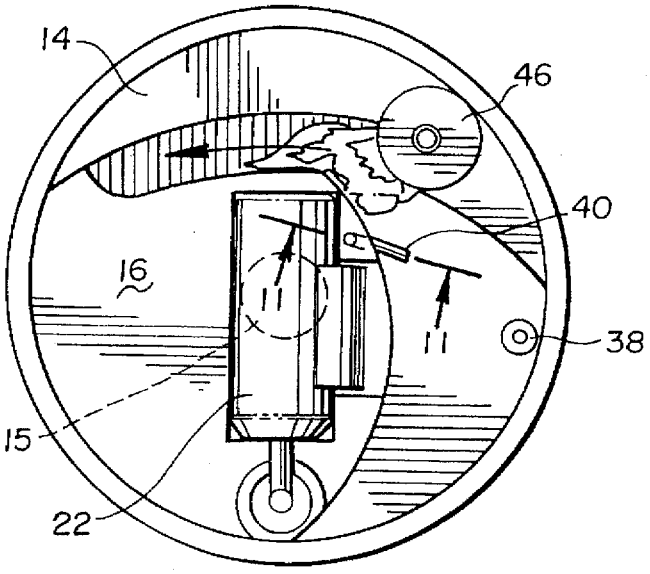
FIG. 10 is a top plan view of the invention showing the detonator in the armed position.

The rotor 16 is shown in the "in line" position in FIG. 10. The in line or armed position refers to the situation where the rotor 16 is in a position so that the detonator 22 is aligned with the lead assembly 15 thus creating an aligned firing train.

The rotor 16 also includes a boss 33 and shear tab 34. The boss 33 and shear tab 34 are manufactured or machined as part of the rotor 16 in the preferred embodiment. This eliminates the possibility of safety failure due to missing parts.

Figure 9A:
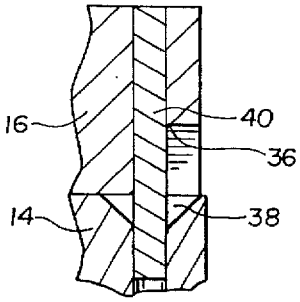
FIG. 9*a* is a cross sectional view taken along the lines 9—9 of FIG. 7 showing the anti-rebound spring of the invention in its initial position.
Figure 9B:
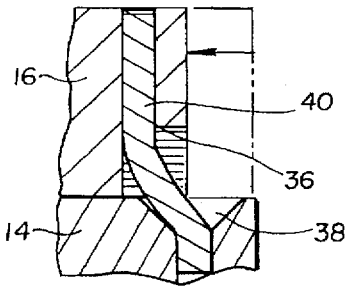
FIG. 9*b* is a cross sectional view taken along the lines 9—9 of FIG. 7 showing the anti-rebound spring of the invention after the ignition of the primer.

The rotor 16 further includes spring aperture 36. The base 14 includes a retaining aperture 38. Aperture 36 and retaining aperture 38 are proximate and are axially aligned in the preferred embodiment. These apertures 36 and 38 receive anti-rebound spring 40 and are sized and configured to hold and retain spring 40 until such time as the rotor 16 travels from its out of line position to its in line position. As shown in FIG. 9*a*, the anti-rebound spring or pin biasing means 40 extends from the rotor 16 to the base 14 with the rotor 16 in the out of line position. The spring 40 is made of spring steel in the preferred embodiment and is of a strength sufficient to hold the rotor 16 in place until that time in the operation of the device 10 when it is pulled out of aperture 38 in base 14. As shown in FIG. 9*b*, as the rotor 16 moves, the spring 40 bends and is pulled out of aperture 38 but remains in aperture 36 of rotor 16. The spring 40 acts as an anti-rebound mechanism for the rotor 16 after it is removed from the base 14. This will be discussed later in this description.

The base 14 also holds a primer 42. The primer 42 includes a primer housing 41, primer material 43, primer insulated connecting wire 44. The primer assembly 42 rests in the base 14 of the device 10 as shown in FIGS. 2 and 3. The primer housing 41 is made of aluminum in the preferred embodiment. The primer material 43 is of any known type of appropriate explosives. A spacer 46 is utilized in the preferred embodiment and rests on the primer 42 around the wire 44. The spacer is made of aluminum and holds the primer 42 in position in the preferred embodiment. The primer connecting wire 44 is connected to the proper electronics (arming circuit) so that a signal may be sent when ignition of the primer 42 is desired. The primer 42 is located proximate the shear tab 34 so that upon ignition of the primer 42 the shear tab 34 will be sheared so that the rotor 16 may move from one position to another.

The base 14 further includes a groove or channel 48. The groove 48 is of a size and configuration such that the rotor 16 may be guided in travel from the out of line to an in line position where the detonator 22 is in line with the explosive lead 15. As discussed earlier, the rotor 16 includes a boss 33. The boss 33 travels in the groove 48 in the preferred embodiment. In essence, the primer's expanding gases drive the boss 33 (piston) in the groove 48 (cylinder) to move the rotor. The base 14 further includes a shear tab recess 49. This recess 49 is sized and configured to receive the shear tab 34 in the preferred embodiment. This recess 49, in conjunction with the shear tab 34, retains the rotor 16 in the out of line position. The recess 49 and tab 34 configuration also prevent the rotor 16 from being assembled in the armed position. Assembly is prevented if the tab 34 is not in recess 49.

Referring to FIGS. 2, and 4–6, the setback lock 55 is shown. The lock 55 includes setback spring 56 and setback weight 58. The base 14 also includes a lock aperture 52 and lock cavity 54 for receiving the setback lock 55. The setback spring or biasing means 56 is cooperatively connected to the base 14 proximate an aft end and operatively contacts the setback weight 58 proximate a forward end. The spring 56 holds the weight 58 in place in the preferred embodiment but the weight 58 and spring 56 are not connected. The spring 56 is of a double torsion bar configuration in the preferred embodiment. However, those skilled in the art will recognize any suitable configuration may be utilized. The spring 56 of the preferred embodiment is sized for operation in excess of 10,000 g-forces to prevent accidental unlocking. The lock aperture 52 and cavity 54 are sized and configured to accept and hold the lock 55. The lock cavity 54 is configured to include a ledge or detent 57 to retain the weight 58 when desired. In the preferred embodiment, the weight 58 is asymmetrical. The weight 58 includes a first end 61 and a second end 63 where the first end 61 has a greater mass than the second end 63.

Figure 4:
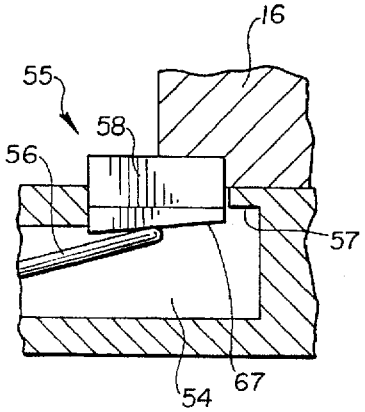
FIG. 4 is a cross sectional view taken along the lines 4—4 of FIG. 3 showing the first setback lock in the initial locked position.
Figure 5:
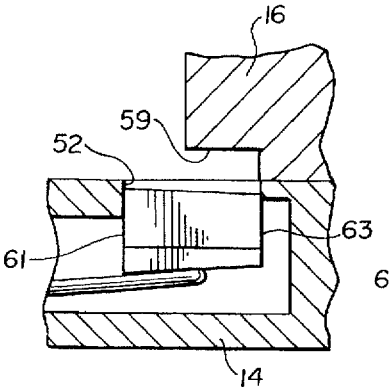
FIG. 5 is a cross sectional view taken along the lines 4—4 of FIG. 3 showing the first setback lock traveling between the locked and unlocked positions.
Figure 6:
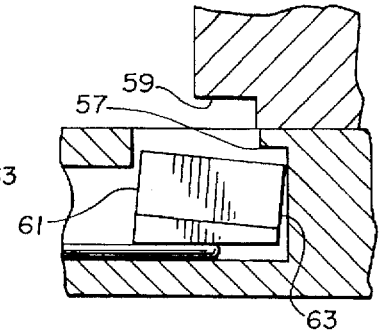
FIG. 6 is a cross sectional view taken along the lines 4—4 of FIG. 3 showing the first setback lock in the unlocked position.

Referring specifically to FIG. 4, the lock 55 is shown in the locked position. The rotor 16 is adjacent to and abuts the weight 58. A notch 59 is included in the rotor 16 in the preferred embodiment to contact the weight 58. In this manner, the rotor 16 is prevented from moving from the out of line position until certain conditions are met. The spring 56 holds the weight 58 in this first position as shown in FIG. 4.

The first lock or setback lock 55 requires gun launch setback g's to remove it. The first lock or setback lock 55 is shown in operation in FIGS. 4–6. FIG. 4 shows the lock in the initial locked position. The rotor 16 is held in place by the setback lock 55 as it is protruding from the aperture 52. At setback, the g-forces on the weight or locking body 58 overcome the spring force of spring 56 and the weight 58 travels down (see FIG. 5). As the projectile experiences acceleration, the weight 58 drives against the spring 56. The locking body 56 is designed in the preferred embodiment such that the underside 67 slopes upwardly from the first end 61 to the second end 63. As seen best in FIG. 6, due to the shape of the weight 58 in the preferred embodiment, the first end 61 of the weight 58 bottoms out in the housing 54 first and the angled bottom causes the weight 58 to tip to the right moving the second end 63 toward detent 57. The ledge or undercut detent 57 stops and captivates the weight 58 when the g-forces no longer exceed the spring force of spring 56. The latching of the lock 55 is the result of the setback of the projectile launch. In this way, the rotor 16 is no longer blocked by the first lock 55.

Figure 7:
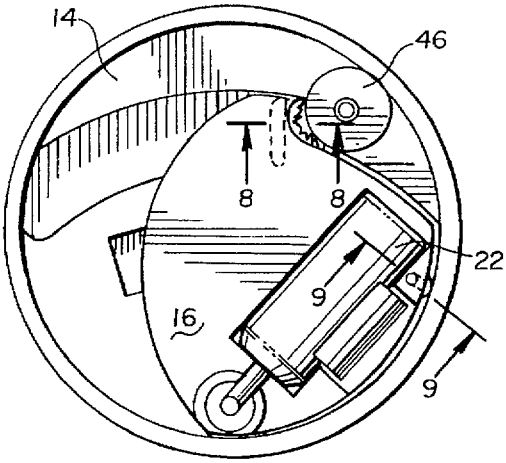
FIG. 7 is a top plan view of the invention showing the ignition of the primer.
Figure 8:
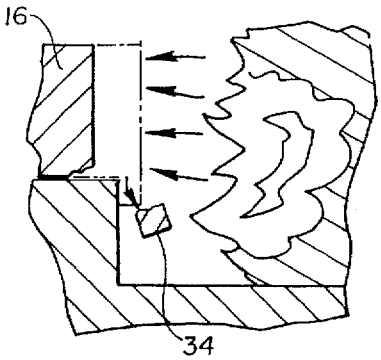
FIG. 8 is a cross sectional view taken along the lines 8—8 of FIG. 7 showing the ignition of the primer and the removal of the shear tab of the rotor.

The second lock or shear tab lock 34 is sheared at the time of arming. As discussed above, much of the device 10 is mechanical in nature but electronics is used to control the final arming and detonation. Electronics detects the second environment and assures safe separation. Once safe separation is satisfied, the electronic input to arming is permitted. The primer 42 is ignited at the appropriate time and as shown in FIGS. 7 and 8 the shear tab 34 is sheared. Therefore, after ignition of the primer 42 the second lock 34 is removed. The venting of the primer 42 reacts against the rotor boss 33 to shear lock 34 and then push the rotor 16 in line as shown in FIG. 10. The use of a simple explosive primer 42 as an electro-explosive transducer to move the rotor 16 in line permits extremely small implementation by integrating it into the rotor/base configuration.

Figure 11:
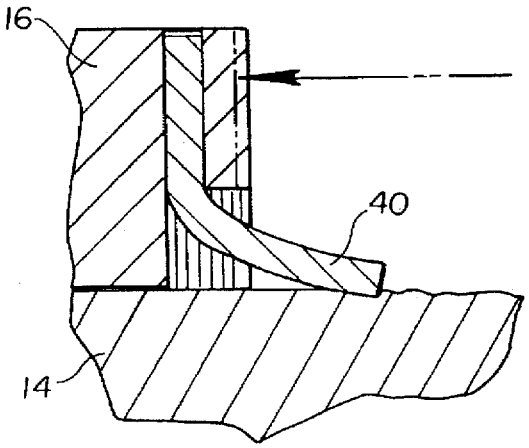
FIG. 11 is a cross sectional view taken along the lines 11—11 of FIG. 10 showing the anti-rebound spring in its anti-rebound position.

Referring now to FIG. 10, if the primer is ignited and shears second lock 34, the anti-rebound spring 40 is pulled out of aperture 38 and is dragged across the base 14 until the rotor 16 is fully rotated and then serves an anti-rebound function. Because of the movement of the rotor 16 the spring 40 moves with the rotor 16 until fully rotated and then digs into the base 14 as shown in FIG. 11 when the rotor 16 stops. After arming, the spring 40 holds the rotor 16 in the in line position to prevent rotation to the out of line position.

Figure 12:
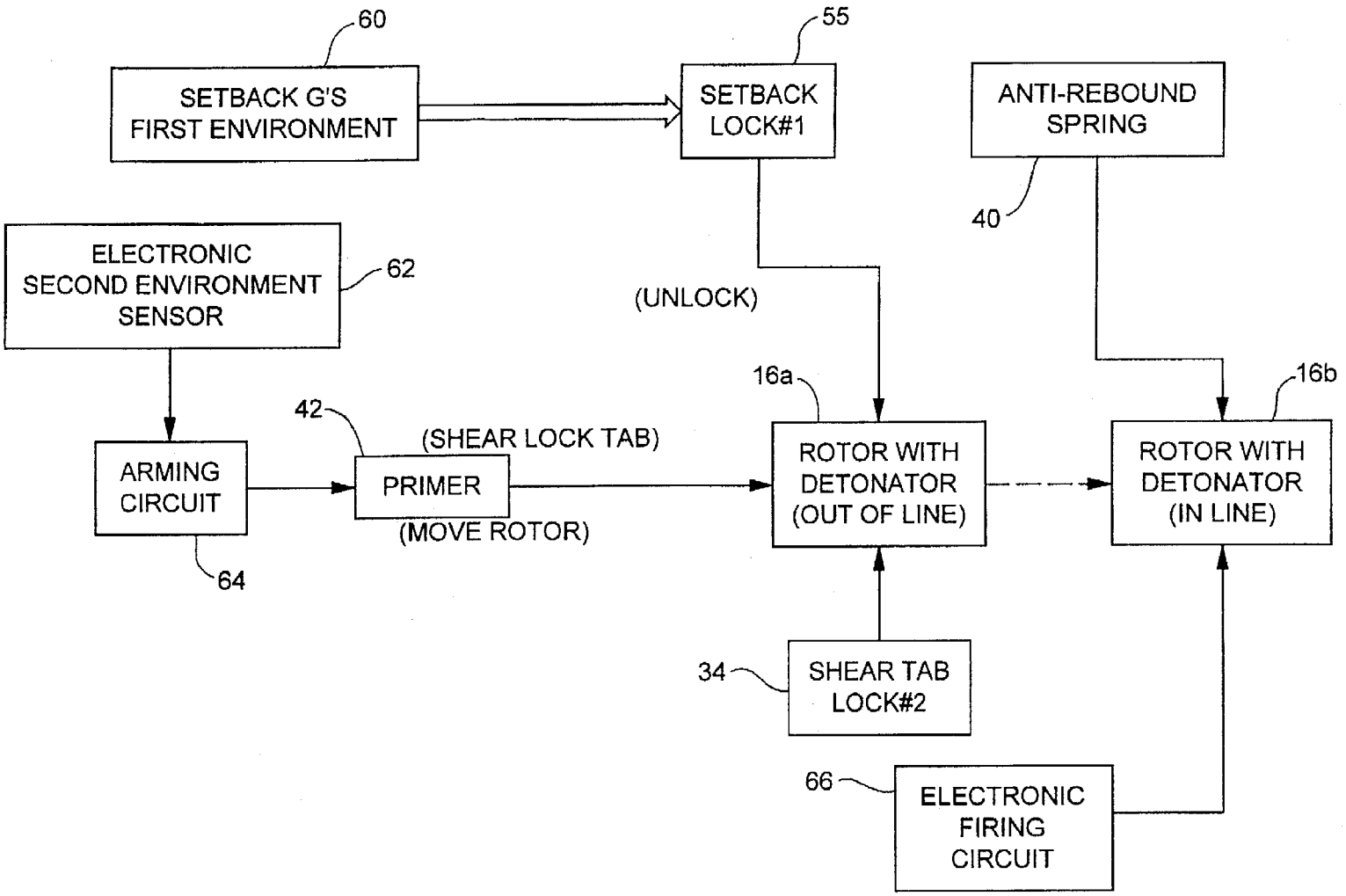
FIG. 12 is a block diagram illustrating the various electronics of the invention and the operation of the invention with a fuze device.

The apparatus 10 will now be described in operation with reference to FIG. 12. As stated above, the device 10 is utilized to provide a safety mechanism so that the munition may not be armed until desired. The device 10 is assembled with the rotor 16 in the "out of line" position as represented by block **16*a*. The "in line" position is represented by block 16*b*. In the out of line position 16*a*, the explosive lead 15 is shielded from the detonator 22 and is not aligned with lead 15. Further, the setback lock 55, block 55 in FIG. 12, is in the locked position thereby maintaining the rotor 16 in the out of line position. The shear tab lock or second lock 34 (block 34 in FIG. 12) is also intact and holds the rotor 16** in the out of line position.

Block 60 represents the first environment which is required to start the operation of the device 10. The setback g-forces act on the setback lock 55 and force the weight 58 into the lock cavity 54 and remove it from the rotor 16. The Weight 58 is captivated or retained by the lip 57 as described above. At this point, the rotor 16 is still in the out of line position as shown by block 16a, held by the shear tab lock 34.

An electronic sensor 62 including electronics and sensing means senses a second environment which is a necessary condition before the second lock 34 can be removed. The sensor 62 is located within or connected to the munition. The second environment sensor 62 may be of any known type which is suited for this application and is known to those skilled in the art. The sensor 62 may sense barrel escape, turns counting, timing or any other means for sensing a second environment. The electronics 62 also establish that a-safe separation distance has been reached. Again, the particular circuitry and peripherals necessary to establish that safe separation has been reached are of a known type and are known to those skilled in the art.

An arming circuit is represented by block 64 and is connected to the sensor 62. The sensor electronics 62 sends a signal to the arming circuit 64 that safe separation has been reached and that the rotor 16 may be moved. The arming circuit 64 is connected to the primer 42 shown here as block 42. The circuitry of arming circuit 42 is known to those skilled in the art. The arming circuit or arming signal 64 in combination with the sensor 62 is a means for igniting or ignites the primer 42. The ignition of the primer 42 shears the rotor shear tab 34 which is holding the rotor in the out of line position **16*a*, thereby removing the second lock 34. The primer output or ignition also continues to or helps to move the rotor 16. The rotor 16 rotates about the pivot shaft 18 to the armed, in line position as represented in block 16*b*. The anti-rebound spring 40 is also pulled out of the base 14 as the primer 42 moves the rotor 16. As discussed earlier, the spring 40 moves across the base 14 and digs in to the base 14 to prevent possible rebound of the rotor 16. In this manner, the rotor 16 and detonator 22 are in the full armed position. The dotted line between block 16*a* and 16*b* represents the change in position of the rotor over time. The first and second locks represented by blocks 55 and 34 which act on the rotor 16 have all been removed at the time between blocks 16*a* and 16*b*. The spring 40 is acting as an anti-rebound spring and is still acting on the rotor 16 in position 16*b***.

As represented by block 66, an electronic firing circuit is connected to the detonator lead 28. The detonator lead 28 makes contact with the electronic firing circuit 66 so that the circuit 66 may fire the detonator 22 when predetermined conditions are met. The firing circuit 66 is known to those skilled in the art and any appropriate circuit may be utilized. The electronic firing circuit 66 fires the detonator 22 and the ignition of the detonator 22 ignites the explosive in cavity 17 of lead 15. The hot gases from the detonator 22 and explosives in lead 15 ignite so that the munition will explode or burst. The detonator 22 is next to or proximate the lead 15 and the explosion of the detonator 22 propagates to the lead 15 assuring ignition of the explosive/propellant of the munition or projectile. If an additional lead is used, the lead 15 will ignite that pellet which then ignites the explosive/propellent of the munition.

While not specifically detailed, it will be understood that the various electronic functional blocks are properly connected to appropriate bias and reference supplies so as to operate in their intended manner. It should also be understood that the processing described herein utilizes well known microprocessor technology which is connected to appropriate memory, buffer and other peripheral devices so as to operate in their intended manner. Further, other circuitry configurations and applications thereof other than as described herein can be configured within the spirit and intent of this invention.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A safety and arming apparatus for use with a projectile, comprising:

(a) a housing;

(b) a rotor connected to the housing and rotatable about an axis, the rotor movable between a safe position and an armed position;

(c) first lock means connected to the housing for preventing the rotor from moving from the safe position to the armed position, the first lock means including a mass and a biasing means, the biasing means operatively connected to the housing and operatively contacting the mass for biasing the mass into a first position which prevents rotation of the rotor and for allowing the mass to move into a second position out of the path of the rotor upon a predetermined acceleration of the projectile;

(d) second lock means including a shear tab connected to the rotor for preventing the rotor from moving from the safe position to the armed position;

(e) an electrically actuated primer connected to the housing and proximate the second lock means and the rotor; and (f) primer ignition means connected to the primer for sensing a predetermined condition and igniting the primer when the predetermined condition of the projectile is sensed wherein when the primer ignites, the second lock means is removed directly by expanding gases of the ignited primer and the expanding gases of the ignited primer directly rotate the rotor to the armed position; whereby when the predetermined acceleration has occurred, the first lock means is moved out of the path of the rotor and when the predetermined condition has been sensed the primer ignition means ignites the primer, removing the second lock means and the rotor is moved to the armed position.

2. The apparatus of claim 1 wherein the biasing means is a torsion spring.

3. The apparatus of claim 1 further comprising pin biasing means connected to the rotor for preventing the rotation of the rotor back to the safe position after the second lock is removed and the rotor is moved to the armed position.

4. The apparatus of claim 3 wherein the pin biasing means is spring steel.

5. A safety and arming apparatus for a projectile for providing an out of line safety between an explosive lead and a detonator until predetermined conditions have been met, comprising:

(a) a housing including an explosive lead;

(b) a rotor pivotally connected to the housing, the rotor including the detonator, the rotor rotatable between an out of line position where the detonator is not aligned with the explosive lead and an in line position where the detonator is aligned with the explosive lead;

(c) a setback lock connected to the housing for preventing the rotor from moving from the out of line position to the in line position until setback conditions are met, the setback lock being removed by setback acceleration of the projectile forcing the lock out of the path of the rotor;

(d) a shear tab lock connected to the rotor for preventing the rotor from moving from the out of line position to the in line position until arming is desired;

(e) an electrically actuated primer connected to the housing and proximate the rotor and the shear tab lock for both removing the shear tab lock and rotating the rotor to the in line position when desired; and (f) an arming means connected to the primer for initiating ignition of the primer wherein expending gases of the ignited primer directly remove the shear tab lock and directly rotate the rotor to the in-line position; whereby when setback conditions are reached the setback lock is removed leaving the shear tab lock to prevent the rotor from moving until arming is desired and the arming means initiates ignition of the primer removing the shear tab lock and driving the rotor to the in line position.

6. The apparatus of claim 5 wherein the arming means comprises a sensor for sensing a predetermined condition of the projectile, processing means for establishing a safe separation, and signaling means for igniting the primer.

7. The apparatus of claim 5 further comprising firing means connected to the detonator for igniting the detonator in line with the explosive lead thereby detonating the projectile.

8. The apparatus of claim 5 further comprising pin biasing means connected to the rotor for preventing the rotation of the rotor back to the out of line position after the shear tab lock is removed.

9. The apparatus of claim 5 wherein the housing includes a mating aperture and a detent and the setback lock comprises:

(a) a spring having a first end and a second end, the first end connected to the housing; and (b) a locking body operatively contacting the second end of the spring, the locking body-abutting the rotor in a normally upward position and slidably receivable by the mating aperture in a fixed orientation so as to be actuated downwardly by setback acceleration g-forces, the locking body having an undersurface upwardly sloping toward the detent; whereby when the setback acceleration of the projectile is reached the g-forces on the locking body overcome the forces of the spring and the locking body is driven downward out of the path of the rotor, the locking body underside contacting the housing and the locking body tilting toward the undercut detent and engaging the undercut detent in a downwardly locked position.

10. An apparatus for safing and arming a projectile, comprising:

(a) a housing, the housing including an explosive lead;

(b) a rotor pivotally connected to the housing, the rotor including a detonator and rotatable between a safe position where the detonator is not aligned with the explosive lead and an armed position where the detonator is aligned with the explosive lead;

(c) locking means for locking the rotor in the safe position until removed, the locking means comprising:

(i) first lock means connected to the housing, the first lock means including a mass and a biasing means, the biasing means operatively connected to the housing and operatively contacting the mass for biasing the mass into a first position which prevents rotation of the rotor and for allowing the mass to move into a second position out of the path of the rotor upon a predetermined acceleration of the projectile;

(ii) second lock means including a shear tab connected to the rotor for preventing the rotor from moving from the safe position to the armed position until a predetermined condition exists;

(iii) an electrically actuated primer connected to the housing and proximate the rotor and the second lock means;

(iv) sensing means connected to the primer for sensing the predetermined condition of the projectile; and (v) ignition means connected to the sensing means for igniting the primer wherein when the primer ignites expanding gases are produced, the second lock means is removed directly by the primers expanding gases and the primer's expanding gases directly drive the rotor to the armed position; whereby when the predetermined acceleration is reached and the predetermined condition is sensed the locking means is removed and the rotor rotates from the safe position to the armed position.

11. The apparatus of claim 10 further comprising a firing means connected to the detonator for igniting the detonator causing propagation of gas and flame to the explosive lead thereby igniting the projectile.

12. A method for safing and arming a projectile to be fired from a gun, the steps comprising:

(a) preventing rotation of a rotor which is connected to a housing with a safing lock and an arming lock, the safing lock including a weight and biasing means connected to the housing and positioned with the weight in path or the rotor, the arming lock including a shear tab connected to the rotor in a recess in the housing and an electrically actuated primer connected to the housing proximate the shear tab and the rotor;

(b) firing the projectile;

(c) moving the weight of the safing lock from the path of the rotor when a predetermined acceleration of the projectile is reached forcing the biased weight out of the path of the rotor;

(d) sensing a predetermined condition for arming the projectile;

(e) igniting the primer thereby removing the arming lock by directly applying expanding gases of the primer against the arming lock;

(f) directly rotating the rotor with the expanding gases from the ignited primer, wherein the rotation of the rotor orients a detonator in line with an explosive lead in the projectile.

13. The method of claim 12 further comprising the step of igniting the detonator.

* * * * *

UNITED STATES PATENT AND TRADEMARK OFFICE
CERTIFICATE OF CORRECTION

PATENT NO. : 5,693,906

DATED : December 2, 1997

INVENTOR(S) : Peter H. Van Sloun

It is certified that error appears in the above-identified patent and that said Letters Patent is hereby corrected as shown below:

Col. 2, line 51, delete "sating" and insert -- safing --;

Col. 2, line 59, delete "tier" and insert -- for --;

Col. 4, line 39, delete "i0" and insert -- 10 --;

Col. 5, line 13, delete "PBXN5" and insert -- PBXN-5 --;

Col. 5, line 59, delete "I0" and insert -- 10 --;

Col. 7, line 45, delete "Weight" and insert -- weight --;

Col. 7, line 58, delete "a-safe" and insert -- a safe --;

Signed and Sealed this

Tenth Day of March, 1998

Bruce Lehman

*Attest:*

BRUCE LEHMAN

*Attesting Officer*

*Commissioner of Patents and Trademarks*